US008215979B2

(12) United States Patent
Shamoto et al.

(10) Patent No.: US 8,215,979 B2
(45) Date of Patent: Jul. 10, 2012

(54) LEVER-TYPE CONNECTOR

(75) Inventors: Wataru Shamoto, Yokkaichi (JP); Kenji Makino, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/050,214

(22) Filed: Mar. 17, 2011

(65) Prior Publication Data

US 2011/0230080 A1 Sep. 22, 2011

(30) Foreign Application Priority Data

Mar. 17, 2010 (JP) ..... 2010-061236

(51) Int. Cl.
*H01R 13/62* (2006.01)

(52) U.S. Cl. ..... 439/372

(58) Field of Classification Search ..... 439/372, 439/376, 157, 160, 489
See application file for complete search history.

(56) References Cited

U.S. PATENT DOCUMENTS 5,823,809 A * 10/1998 Wakata ..... 439/157
5,873,745 A * 2/1999 Duclos et al. ..... 439/157
6,315,585 B1 * 11/2001 Oka ..... 439/157
6,361,356 B1 * 3/2002 Heberlein et al. ..... 439/489
6,558,176 B1 * 5/2003 Martin et al. ..... 439/157
6,648,658 B2 * 11/2003 Okabe et al. ..... 439/157
6,899,554 B1 * 5/2005 Osada ..... 439/157
7,281,933 B1 * 10/2007 Shigeta et al. ..... 439/157
7,396,240 B2 * 7/2008 Frederiksen et al. ..... 439/157
7,396,241 B2 * 7/2008 Matsuura et al. ..... 439/157
7,500,860 B2 * 3/2009 Tajiri et al. ..... 439/160
7,618,271 B2 * 11/2009 Shiga ..... 439/157
7,637,757 B2 * 12/2009 Matsumura et al. ..... 439/157
7,670,159 B2 3/2010 Shamoto et al.
7,686,631 B1 * 3/2010 Eow et al. ..... 439/157
7,708,573 B2 * 5/2010 Takahashi ..... 439/157
8,033,844 B2 * 10/2011 Kobayashi et al. ..... 439/157
8,057,245 B2 * 11/2011 Sakamaki et al. ..... 439/157
2009/0170358 A1 * 7/2009 Shamoto et al. ..... 439/157
2011/0104921 A1 * 5/2011 Shamoto ..... 439/157
2011/0230071 A1 * 9/2011 Shamoto et al. ..... 439/157

* cited by examiner

*Primary Examiner* — Alexander Gilman
(74) *Attorney, Agent, or Firm* — Gerald E. Hespos; Michael J. Porco

(57) ABSTRACT

A lever (40) is rotatable about shafts (19) between a projecting position where side plates (42) project to a large extent from the rear end of a housing (10) and a retracted position where the side plates (42) do not project far the rear end of the housing (10). Projecting pieces (61) project forward on front end edges of the side plates (42) and leading ends of the projecting pieces (61) overlap the rear end of the housing (10) in forward and backward directions at the projecting position. At the projecting position, spaces (63, 64) are formed by the opposite side edges of the projections (61), the front edges of the side plates (42) and the rear end of the housing (10). These spaces include escaping spaces (63) that receive cam followers (85) on the mating housing (80) at the retracted position.

16 Claims, 9 Drawing Sheets

LEVER-TYPE CONNECTOR

BACKGROUND OF THE INVENTION

1. Field of the Invention

The invention relates to a lever-type connector.

2. Description of the Related Art

U.S. Pat. No. 7,670,159 discloses a conventional lever-type connector. This connector includes a housing with a front end that is connectable to a mating housing and a rear end from which wires are drawn out. The connector also includes a lever with a coupling and two side plates that project from the opposite ends of the coupling to define a U-shape. The lever is mounted to straddle the housing from behind and is rotatable relative to the housing. The side plates have cam grooves and the mating housing has cam followers at positions corresponding to the cam grooves. The lever is rotated with the cam followers at the entrances of the cam grooves. Thus, the cam followers displace relatively along the cam grooves to display a force multiplying action that connects the two housings with a low operation force.

The lever is rotatable to a projecting position where the side plates project to a large extent from the rear end edge of the housing and a retracted position where the side plates hardly project from the rear end edge of the housing. At the projecting position, a V-shaped space portion is open at one lateral side between the front end edges of the side plates and the rear end edge of the housing.

The wires drawn out from the rear end of the housing of the above-described conventional lever-type connector may protrude into the space because an opening area of the V-shaped space is large when the lever is at the projecting position. Thus, the protruding wires may be caught between the front end edges of the side plates and the rear end edge of the housing in the process of bringing the lever to the retracted position. The space can be closed by widening the side plates so that the front end edges of the side plates are more forward. However, a projection formed on the housing or the mating housing may interfere with the front end edges of the side plates at the retracted position.

The invention was developed in view of the above situation and an object thereof is to prevent one or more wires from being caught.

SUMMARY OF THE INVENTION

The invention relates to a lever-type connector with a housing that is connectable to a mating housing and from which wires are to be drawn out. A lever is supported rotatably on a shaft of the housing and includes at least one side plate that is engageable with the mating housing. The lever is rotatable about the shaft between a projecting position where the side plate projects to a large extent from the rear end of the housing and a retracted position where the side plate projects to a small extent or does not project from the rear end of the housing. Rotation of the lever displays a force multiplying action to pull the mating housing during a connecting operation of the two housings. At least one projection projects forward on the front edge of the side plate and has a leading end that at least partly overlaps the rear end edge of the housing in forward and backward directions at the projecting position. The projection suppresses protruding of the wires. Thus, the wires will not be caught between the front end edge of the side plate and the rear end edge of the housing.

At least one hollow space is formed by the opposite side edges of the projecting piece, the front end edge of the side plate and/or the rear end edge of the housing at the projecting position.

The at least one space preferably includes an escaping space for receiving a projection formed on the housing or the mating housing at the retracted position. Thus, interference of the side plate and the projection is avoided and a smooth rotation or displacement of the lever is ensured.

The side plate preferably is formed with a cam groove and the mating housing preferably has a plurality of cam followers. Any one of the cam followers is selectively inserted into the cam groove and relatively moved along the cam groove by the rotation of the lever to display the force multiplying action when connecting the two housings.

The projection preferably is the cam follower that is not inserted into the cam groove. The cam follower that is not inserted into the cam groove can escape into the space near the shaft at the retracted position. Thus, a plurality of cam followers can be formed on the mating housing without problem.

The leading end of the projection preferably is at the same position as or behind the front end edge of the housing. Thus, external foreign matter is not likely to interfere with the leading end of the projection.

The shaft preferably is supported on a support projecting back from a part of the rear end edge of the housing. The leading end of the projection preferably at least partly overlaps the support in forward and backward directions at the retracted position. Thus, the leading end of the projection can reach the overlapping position with the housing without the projection projecting to a considerable extent. As a result, the effect of the invention can be enjoyed more effectively.

The housing and the lever may comprise locking members to hold the lever in a properly mounted state on the housing at the retracted position.

The projection preferably is thinner than another portion of the lever.

These and other objects, features and advantages of the present invention will become more apparent upon reading of the following detailed description of preferred embodiments and accompanying drawings.

DETAILED DESCRIPTION OF THE PREFERRED EMBODIMENTS

A lever-type connector according to the invention is illustrated in FIGS. 1 to 9 and includes a housing 10 and a lever 40. The housing 10 is connectable to a mating housing 80. In the following description, ends of the housings 10, 80 to be connected to each other are referred to as front ends concerning forward and backward directions FBD.

Figure 6:
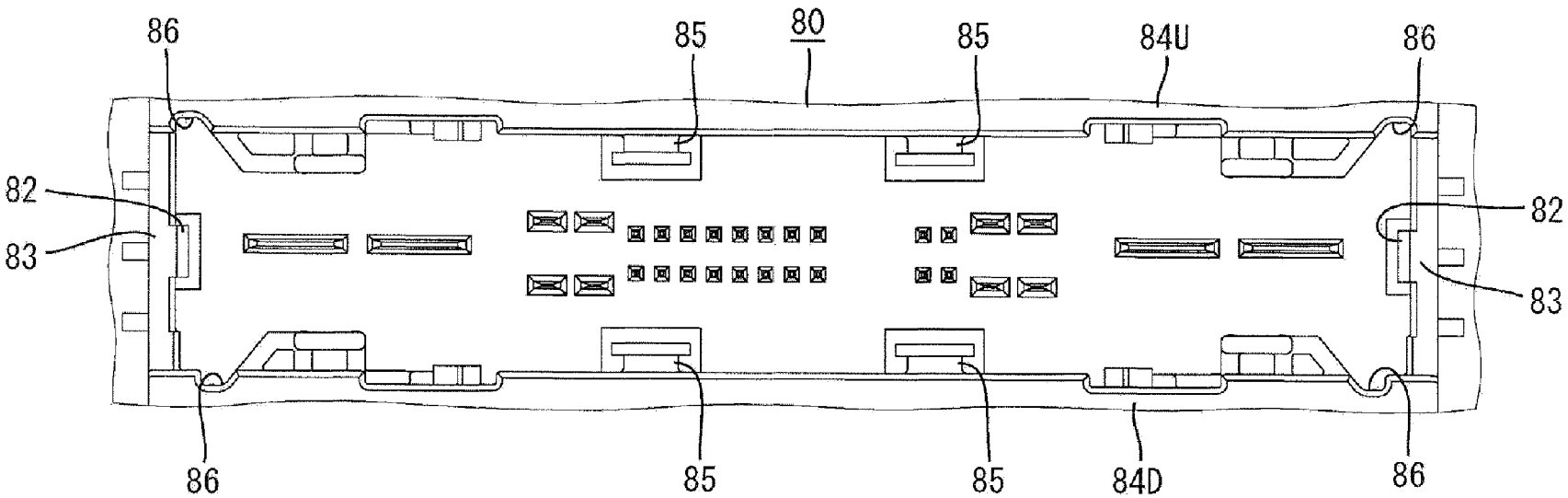
FIG. 6 is a front view of a mating housing.

The mating housing 80 is made e.g. of synthetic resin and includes a rectangular tubular receptacle 81 that is long in a width direction WD, as shown in FIG. 6. Unillustrated male tabs project into the receptacle 81. Two engaging portions 82 project from the inner surfaces of side walls 83 at substantially opposite ends in the width direction WD. As shown in FIG. 6, the engaging portions 82 are claw-shaped and are in substantially central parts of front ends of the side walls 83 in a height or forward and backward direction FBD.

Cam followers 85 project from the inner surface of each of upper and lower walls 84U, 85D of the receptacle 81. The cam followers 85 include two upper cam followers 85 arranged at the opposite sides of a widthwise center of the upper wall 84U, and two lower cam followers 85 arranged at the opposite sides of a widthwise center of the lower wall 84D. In other words, the cam followers 85 are arranged substantially symmetrically with respect to the height direction (forward and backward direction FBD) and the width direction WD. Recesses 86 are formed at positions of the inner surfaces of the upper and lower walls 84U, 84D of the receptacle 81 near four corners.

Figure 4:
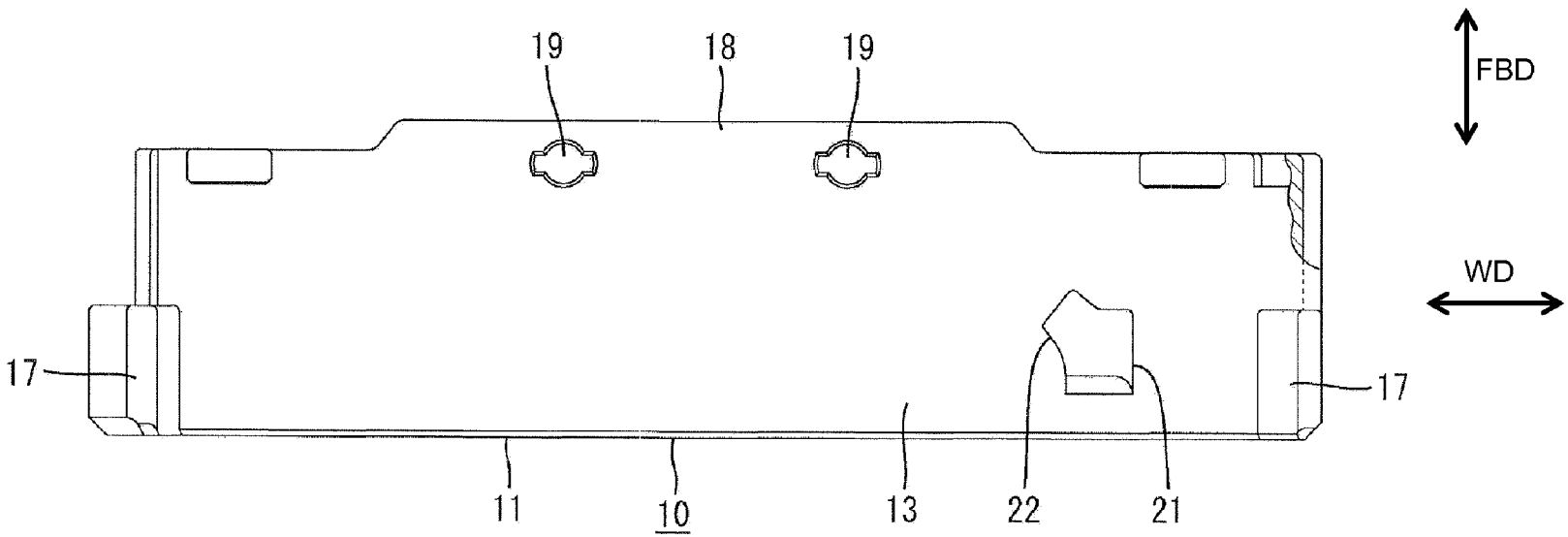
FIG. 4 is a plan view of the housing.
Figure 5:
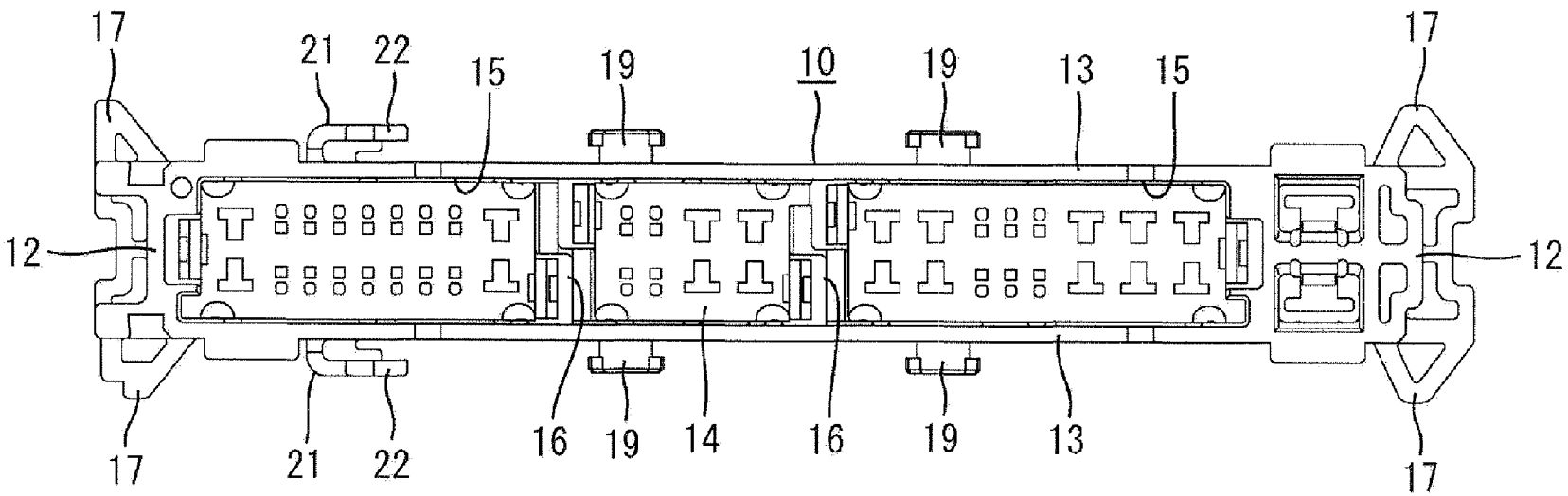
FIG. 5 is a rear view of the housing.

The housing 10 is made e.g. of synthetic resin and includes a main body 11 in the form of a rectangular box long in the width direction WD, as shown in FIGS. 4 and 5. The main body 11 has left and right short sides 12 at opposite ends in the width direction, upper and lower long sides 13 at opposite ends in the height direction (forward and backward direction FBD), a front wall 14 at a front end and an open rear end. Sub-housing accommodating recesses 15 are formed substantially side by side in the width direction WD in the housing main body 11, and partitions 16 are formed between the respective sub-housing accommodating recesses 15. Unillustrated sub housings are to be accommodated into the respective sub-housing accommodating recesses 15 from behind. Female terminal fittings are to be inserted into the respective sub housings, and electrically conductively connected to the respective male tabs when the two housings 10, 80 are connected properly. The female terminal fittings are connected to ends of respective wires 90 to be drawn out to the rear of the housing 10.

Projections 17 are formed at substantially opposite widthwise ends of front end portions of both long sides 13. The respective projections 17 are fit into respective recesses 86 when the two housings 10, 80 are connected properly, but are not fit into the recesses 86 when the two housings 10, 80 are connected erroneously thereby detecting an erroneously connected state of the two housings 10, 80.

Central parts of the rear edges of the long sides 13 project farther back than the lateral ends to define supports 18. Two shafts 19 are arranged on opposite sides of each support 18, and rear ends of the shafts 19 are located on the supports 18. A hook 21 projects at one widthwise end of the front end portion of each long side 13. The hook 21 includes a plate 22 substantially parallel with the outer surface of the long side 13.

Figure 7:
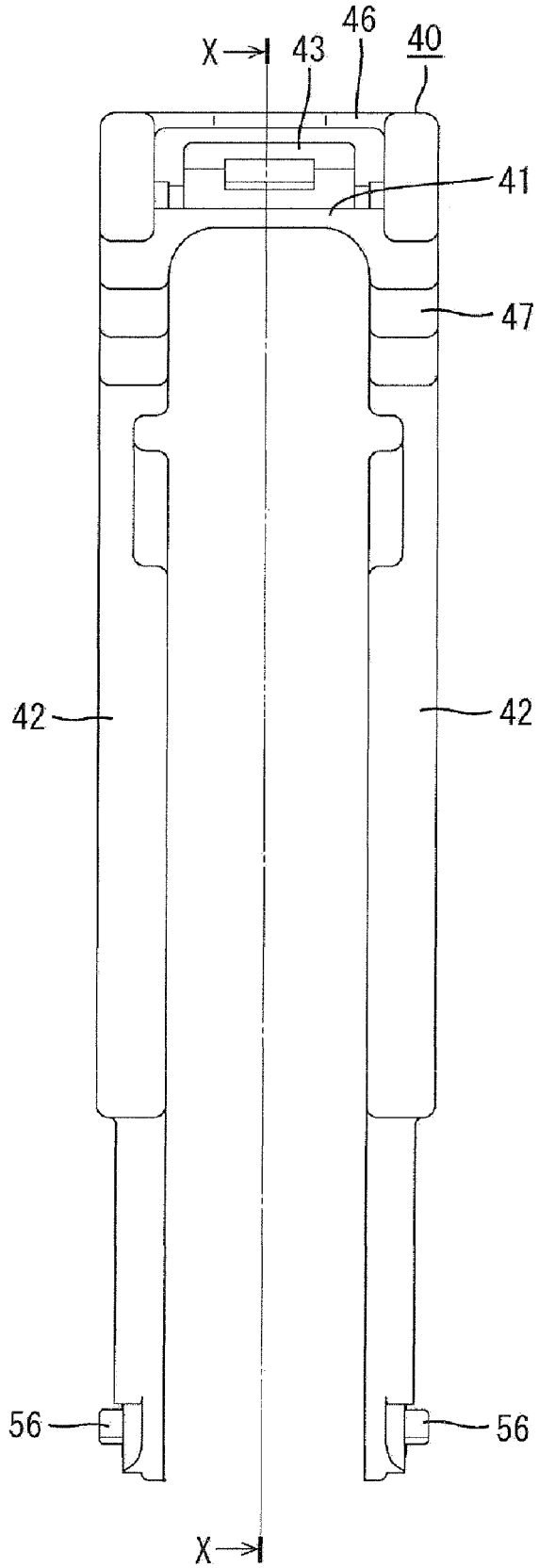
FIG. 7 is a rear view of the lever.
Figure 8:
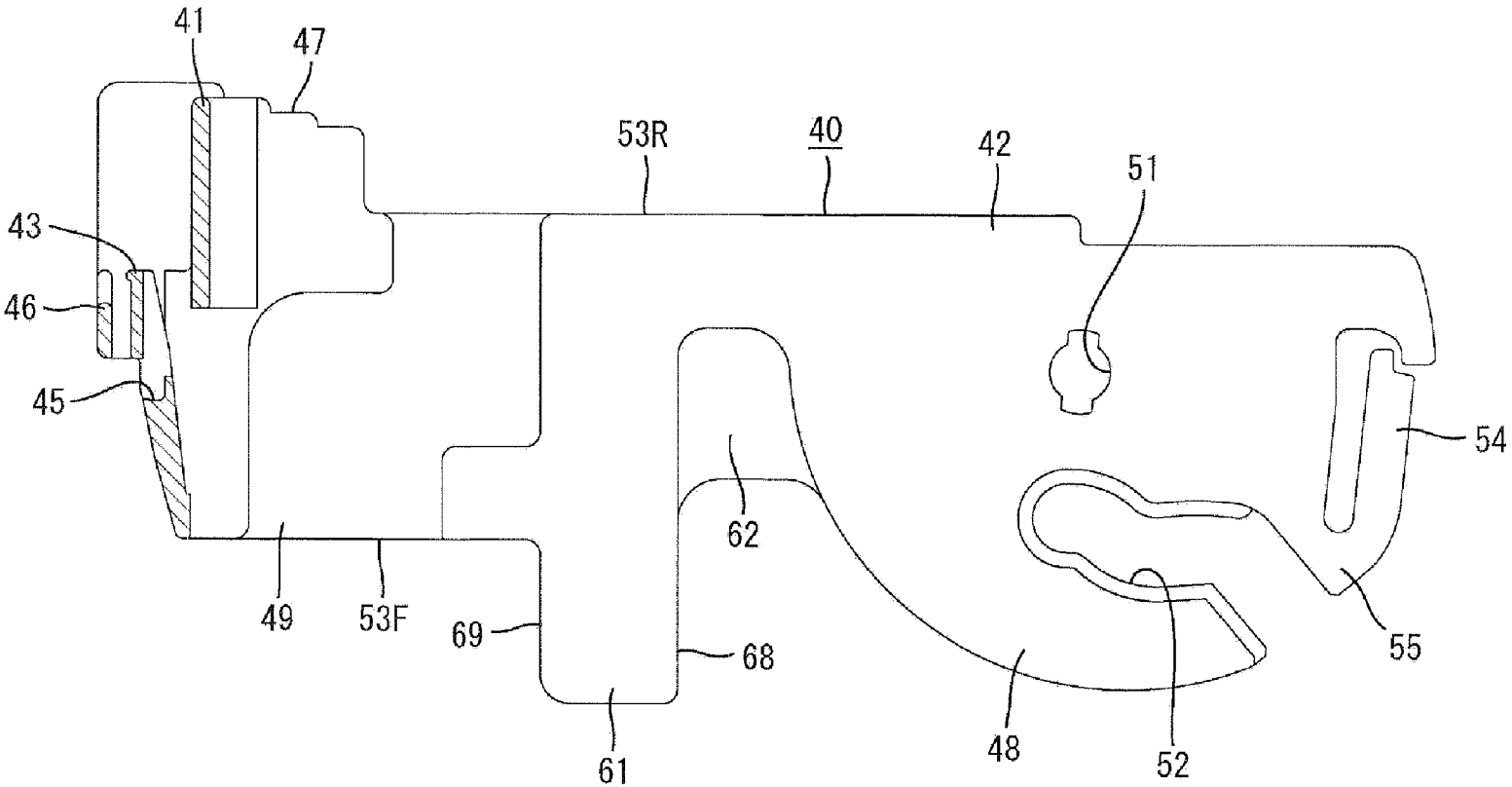
FIG. 8 is a section along X-X of FIG. 7.
Figure 9:
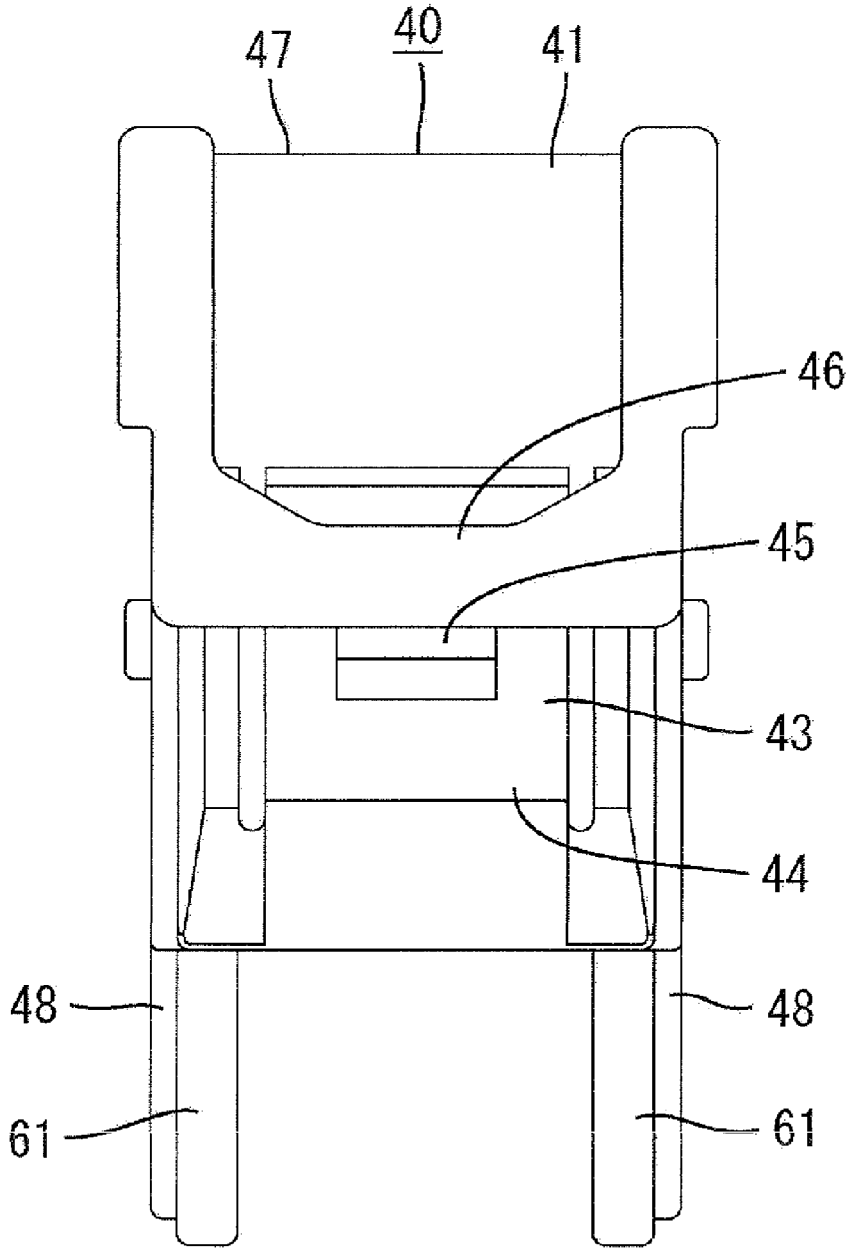
FIG. 9 is a side view of the lever.

The lever 40 is made e.g. of synthetic resin and has a coupling 41 extending in the height direction. Two side plates 42 project in the width direction from opposite ends of the coupling 41 so that the lever 40 defines a U-shape, as shown in FIG. 7. The coupling 41 has a resiliently deformable lock 43, as shown in FIGS. 8 and 9. The lock 43 includes a base 44 at a front end of the coupling 41. The base 44 as a support of resilient deformation. The lock 43 extends back from the base 44. A penetrating lock hole 45 is formed at an intermediate position of the lock 43.

An arched protecting portion 46 is formed at a rear end of the coupling 41 and at least partly surrounds the free rear end of the lock 43. Further, an operable portion 47 projects back and descends stepwise toward one widthwise end along the rear end edges of both side plates 42.

Each side plate 42 includes an action portion 48 distant from the coupling 41 and a link 49 linking the action portion 48 and the coupling 41. The action portion 48 has a substantially arcuate outer peripheral edge, a substantially circular bearing hole 51 and a bottomless cam groove 52 that opens at the outer peripheral edge of the action portion 48.

Figure 3:
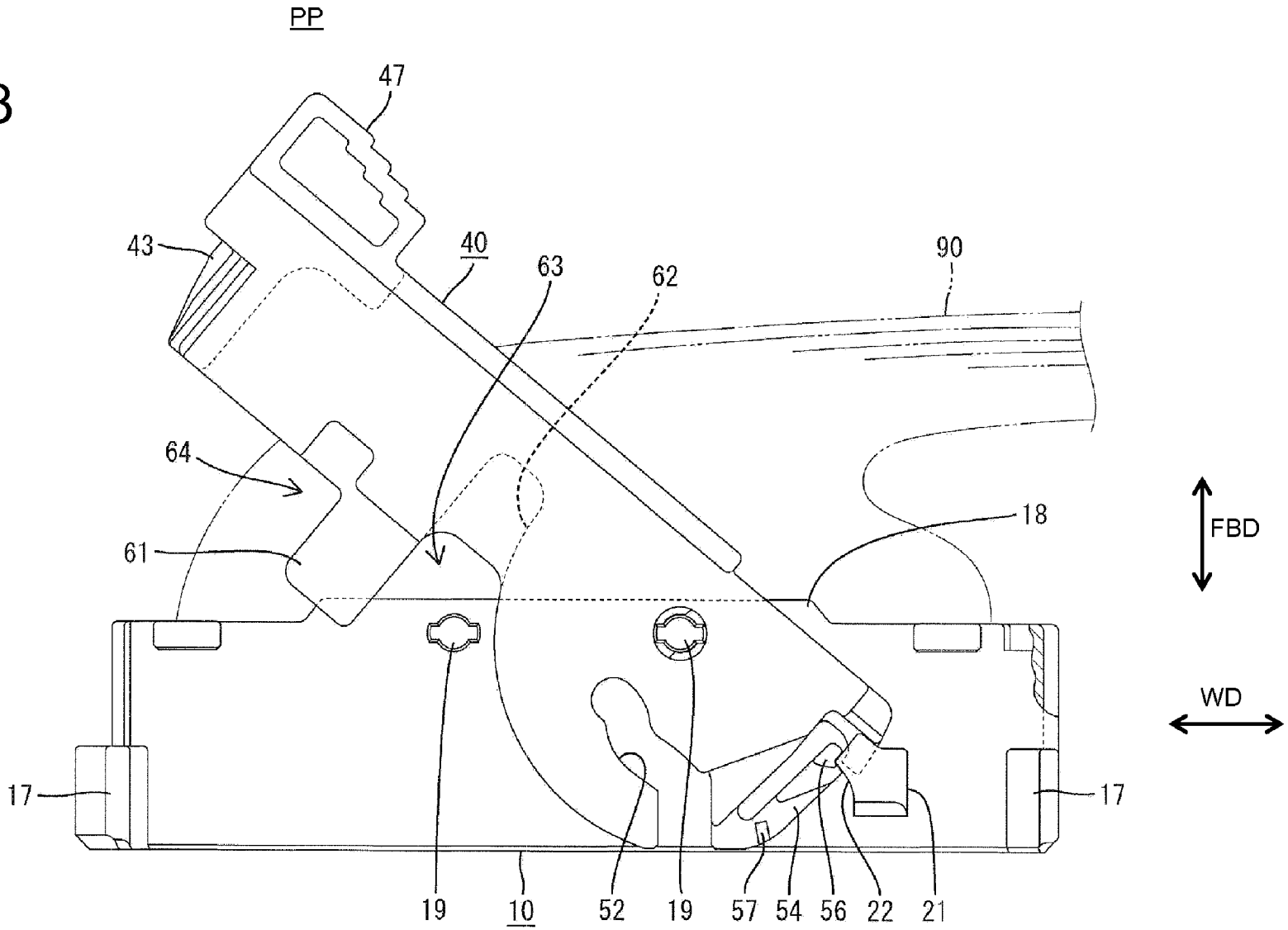
FIG. 3 is a plan view of the housing with the lever held at the projecting position.

A substantially straight edge 53R is formed on a part of the rear end edge of the link 49 except on the operable portion 47, and a substantially straight edge 53F is formed on the front end edge of the link 49 except on a projection 61 to be described later. The action portion 48 has a resiliently deformable resilient piece 54 with a base end 55 near the entrance of the cam groove 52. The base end 55 defines a support for resilient deformation. The resilient piece 54 extends along the outer peripheral edge of the action portion 48 from the base end 55. As shown in FIG. 3, a first projection 56 projects out at a leading end of the resilient piece 54 and a second projection 57 project out at a base end of the resilient piece 54.

Figure 1:
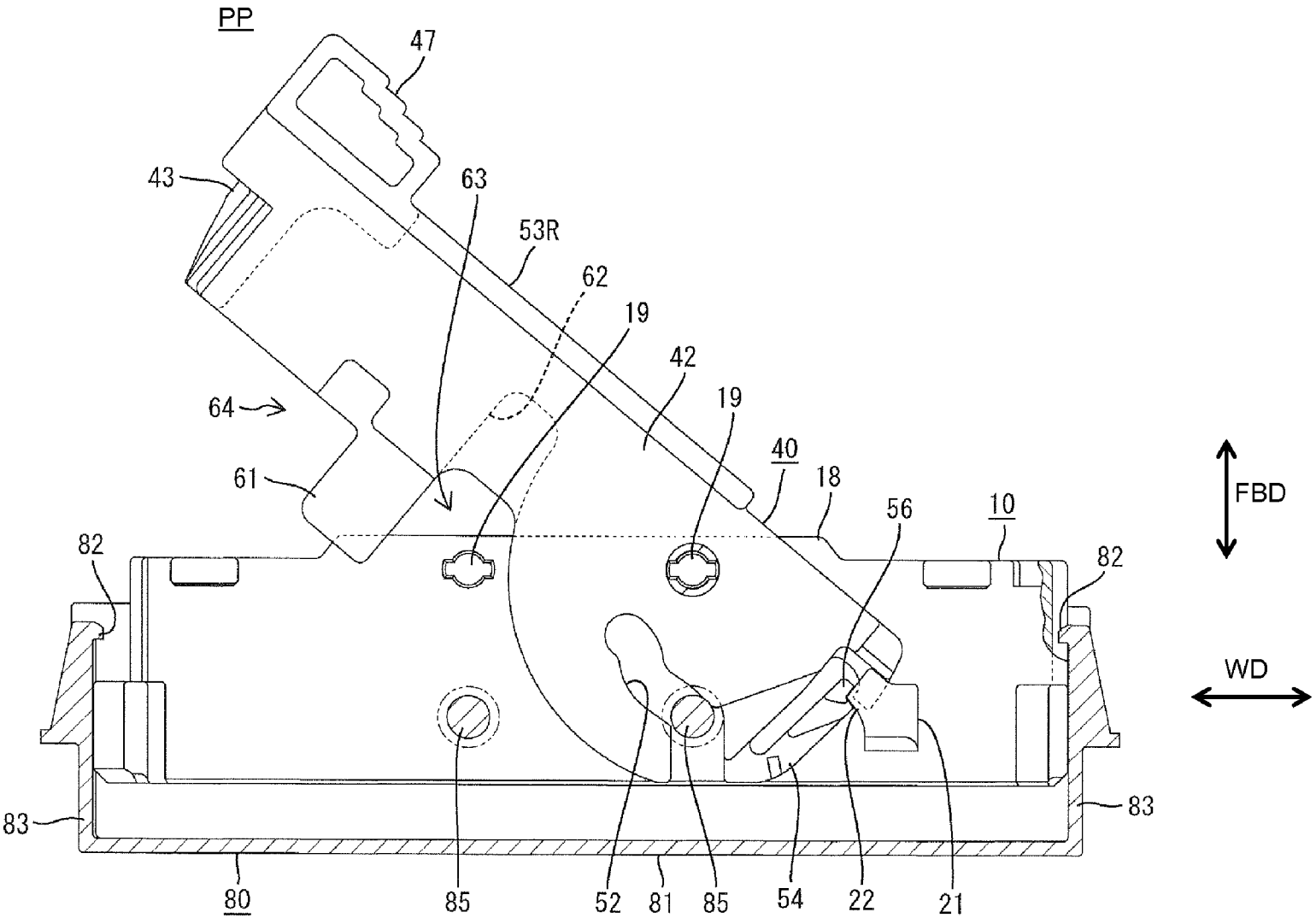
FIG. 1 is a plan view showing a state where a lever is at a projecting position and two housings are partly connected in a lever-type connector of the invention.
Figure 2:
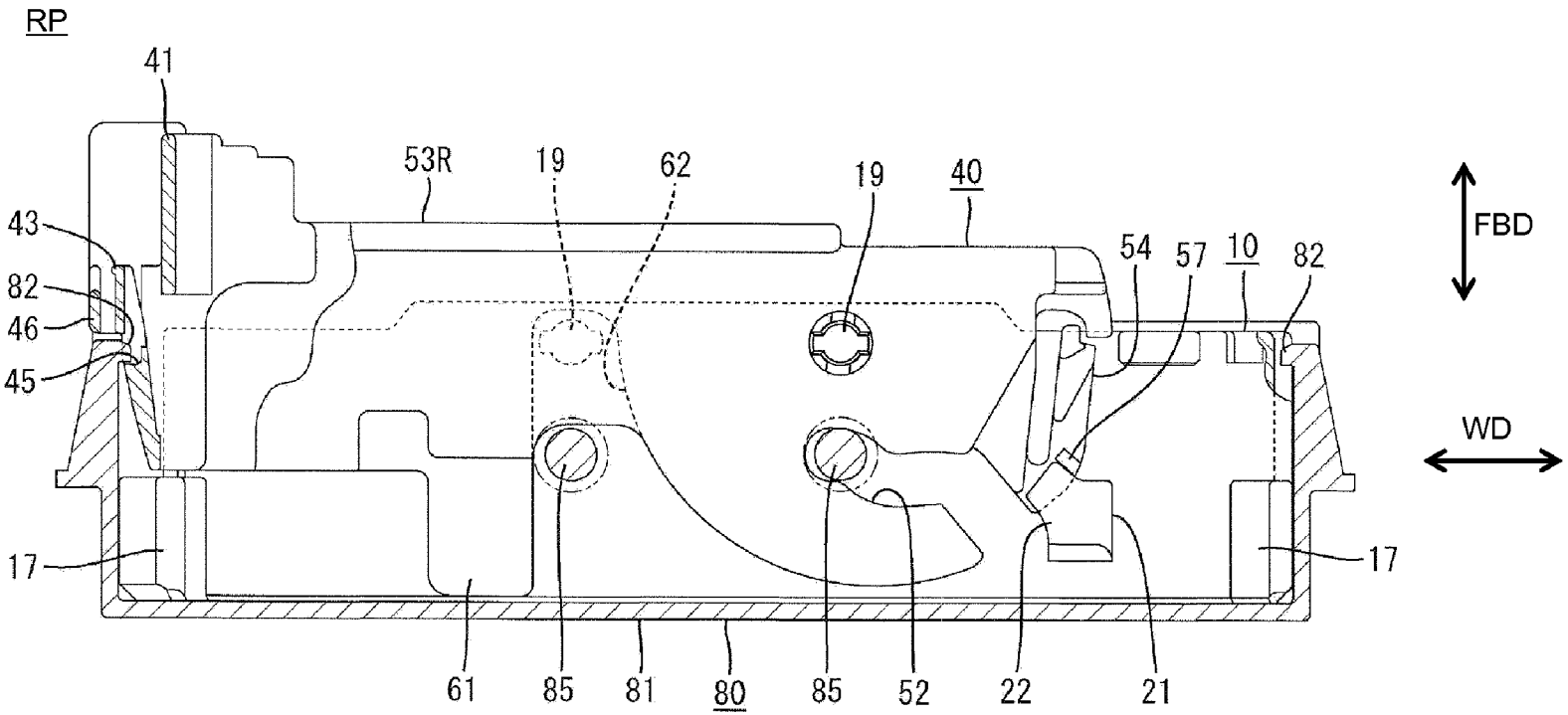
FIG. 2 is a plan view showing a state where the lever is held at a retracted position and the two housings are properly connected.

The lever 40 is mounted from behind to straddle the housing 10 and the shafts 19 at the widthwise side (right side in the shown example) where the hooks 21 are present are fit resiliently into the bearing holes 51 and supported when the lever 40 is mounted. The lever 40 is rotatable about the shafts 19 between a projecting position PP (FIG. 3) and a retracted position RP (FIG. 2). The straight edges 53R are oblique to the rear end of the housing 10 and both side plates 42 project to a large extent from the rear end of the housing 10 when the lever 40 is in the projecting position PP. However, the straight edges 53R are substantially parallel with the rear end of the housing 10 and both side plates 42 project to a small extent from the rear end of the housing 10 when the lever 40 is in the retracted position RP. In other words, at the retracting position RP the longitudinal axes of the side plates 42 are arranged substantially in width direction WD (or at a small angle thereto, such as lower than about 10°) while at the projecting position the longitudinal axes of the side plates 42 are arranged at a large angle with respect to the WD (e.g. more than about 20°) so that the side plates 42 project at a great extent (e.g. more than about twice than when at the retracted position). At the projecting position PP, the first projections 56 of the resilient pieces 54 resiliently engage the plates 22 of the hooks 21 to prevent rotation of the lever 40 toward the retracted position RP. Further, as shown in FIG. 1, the entrances of the cam grooves 52 are open forward at the projecting position PP. Thus, the housing 10 can fit into the receptacle 81 of the male housing 80 and the cam followers 85 enter the cam grooves 52 from the front. At this time, the first projections 56 and the hooks 21 are disengaged by the male housing 80 and the resilient pieces 54 are deformed resiliently to permit the rotation of the lever 40 to the retracted position RP. During the rotation from the projecting position PP to the retracted position RP, the operable portion 47 is pushed from behind for gradually reducing a projecting amount of the side plates 42. During this time, the cam followers 85 slide on the groove surfaces of the cam grooves 52 and a force multiplying action is displayed between the lever 40 and the housing 80 to connect the housings 10, 80 with a low operation force.

At the retracted position RP, the second projections 57 of the resilient pieces 54 engage resiliently with the plates 22 of the hooks 21 to prevent rotation of the lever 40 toward the projecting position PP. Further, at the retracted position RP, the engaging portion 82 fits resiliently into the lock hole 45 of the lock 43 to hold the lever 40 in a properly mounted state on the housing 10. At this time, the cam followers 85 reach back ends of the cam grooves 52 and the female terminal fittings and the male tabs are connected electrically conductively. The free end of the lock 43 may be pressed from the outside upon returning the lever 40 to the projecting position PP to disengage the lock 43 and the engaging portion 82. In this state, the lever 40 may be brought to the projecting position PP. Note that the second projections 57 and the hooks 21 can be disengaged easily by giving an operation force to rotate the lever 40 to the projecting position PP. Further, the protection 46 prevents inadvertent unlocking of the lock 43.

An unillustrated housing different from the housing 10 may be fit into the mating housing 80. This housing differs from the housing 10 in that the hooks 21 are at the opposite widthwise side, but a substantially rear part thereof is structured in common with the housing 10 and the lever 40 can be supported on the shafts 19 at the widthwise side opposite to these shafts 19. In this case, a rotating direction of the lever 40 is opposite to the above direction, and the cam grooves 52 of the lever 40 engage with the cam followers 85 at sides opposite to the above cam followers 85. Thus, the mating housing 80 can be shared by the different housing and the housing 10, and rear parts of the housing 10 and the different housing can be formed using the same mold.

A projecting piece 61 projects forward from the front end edge of the link 49 of the side plate 42. The projecting piece 61 is thinner than the action portion 48 and, as shown in FIG. 8, a straight widthwise edge 68 thereof is arranged to face the outer peripheral edge of the action portion 48 while being separated in the width direction WD, and a substantially straight other widthwise edge 69 thereof is substantially orthogonal to the straight edge 53F. A bottomed recess 62 is formed in the inner surface of the link 49 of each side plate 42 and opens at the front end edge of the link 49.

At the projecting position PP, one corner at the leading end of each projection 61 is at an outer side of the corresponding support 18 of the housing 10 and overlaps the support 18 in forward and backward directions FBD, as shown in FIG. 3. At this time, the wires 90 drawn from the rear end of the housing 10 are accommodated inside the projections 61 and can touch inner surfaces of the projections 61.

A closed first space 63 is formed at the projecting position PP by the first widthwise end 68 of the projecting piece 61, the front edge of the link 49, the outer peripheral edge of the action portion 48 and the rear end edge of the support 18. The recess 62 is adjacent, behind and continuous with the first space 63. Further, a second space 64 is open at the other widthwise side, and is formed by the other widthwise edge 69 of the projecting piece 61, the front end edge of the link 49 and the rear end edge of the housing 10. In other words, the first space 63 is closer to the shafts 19 than the second space 64 and faces the shaft 19 at the widthwise side that does not support the lever 40, and the cam follower 85 at the other widthwise side is not inserted into the cam groove 52, in the rotating direction of the lever 40.

At the retracted position RP, the leading end edges of the projections 61 extend substantially along, but slightly behind the front end edge of the housing 10, as shown in FIG. 2. Further, at the retracted position RP, the shafts 19 at the other widthwise side that do not support the lever 40 can escape by being inserted into the recesses 62 and the cam followers 85 at the other widthwise side that are not inserted into the cam grooves 52 can escape by being inserted into the first spaces 63. In other words, the first spaces 63 define escaping spaces for the cam followers 85 at the other widthwise side. At this time, the cam followers 85 at the other widthwise side are near the base ends of the widthwise edges 68 of the projections 61.

As described above, the leading ends of the projecting pieces 61 are arranged to overlap the rear end edge of the housing 10 in forward and backward directions FBD when the lever 40 is at the projecting position PP. Thus, the projections 61 prevent the wires 90 drawn out from the rear end of the housing 10 from protruding. Therefore, the wires 90 cannot be caught between the front end edges of the side plates 42 and the rear end edge of the housing 10. Further, placing the projecting pieces 61 at the outer sides of the rear end edge of the housing 10 prevents the side plates 42 from being inclined inwardly at the projecting position PP.

The cam followers 85 of the mating housing 80 are inserted in the first spaces 63 at the retracted position RP to avoid interference of the side plates 42 and the cam followers 85. Thus the cam followers 85 can be formed on the mating housing 80 without problem and the mating housing 80 can be shared by the different housing and the housing 10. Further, the leading ends of the projecting pieces 61 are slightly behind or adjacent to the front end edge of the housing 10 at the retracted position RP to avoid interference of external foreign matter with the leading ends of the projecting pieces 61.

Further, the shafts 19 are formed on the supports 18 projecting back from the parts of the rear end of the housing 10 and the leading ends of the projections 61 are arranged to overlap the supports 18 in forward and backward directions FBD at the projecting position PP. Thus, the leading ends of the projecting pieces 61 can overlap the housing 10 without the projecting pieces 61 projecting to a considerable extent. Therefore, the projecting amounts of the projecting pieces 61 can be reduced to prevent the leading ends of the projecting pieces 61 from projecting forward from the front end edge of the housing 10 at the retracted position.

The invention is not limited to the above described and illustrated embodiment. For example, the following embodiments also are included in the scope of the invention.

What are inserted into the first space portions when the lever is at the retracted position may be any arbitrary projections other than the cam followers. In this case, the projections are not limited to those formed on the mating housing and may be those formed on the housing.

The lever may be composed of a single side plate as a whole.

At the retracted position, the rear end edges of both side plates may be arranged at the same position as the rear end edge of the housing.

At the retracted position, the rear end edges of the both side plates may be arranged to be slightly before the rear end edge of the housing.

At the retracted position, the leading ends of the projecting pieces may be arranged at the same position as the front end edge of the housing.

What is claimed is:

1. A lever-type connector, comprising:

a housing having a front end that is connectable to a mating housing and a rear end from which one or more wires are to be drawn out, at least one shaft; and a lever including at least one side plate supported on the shaft of the housing for rotation between a projecting position where the side plate projects to a large extent from the rear end of the housing and a retracted position where the side plate projects to a small extent or does not project from the rear end of the housing, the lever being engageable with the mating housing and displaying a force multiplying action with the mating housing by rotation of the lever for assisting a connecting operation of the two housings, at least one projecting piece projecting forward on a front edge of the side plate a sufficient distance so that a leading end of the projecting piece overlaps the rear end of the housing in forward and backward directions at the projecting position.

2. The lever-type connector of claim 1, wherein hollow spaces are formed by the opposite side edges of the projecting piece, the front end edge of the side plate and the rear end edge of the housing at the projecting position.

3. The lever-type connector of claim 2, wherein the spaces include an escaping space near the shaft, the escaping space receiving a projection formed on the housing or the mating housing when the lever is at the retracted position.

4. The lever-type connector of claim 3, wherein:

the side plate is formed with a cam groove, the mating housing is formed with a plurality of cam followers, one of the cam followers being inserted into the cam groove and relatively moved along the cam groove by the rotation of the lever to display the force multiplying action when connecting the two housings.

5. The lever-type connector of claim 4, wherein the projection is the cam follower that is not inserted into the cam groove.

6. The lever-type connector of claim 1, wherein the leading end of the projecting piece is arranged at the same position as or behind the front end of the housing.

7. The lever-type connector of claim 1, wherein the shaft is supported on a support projecting back from a part of the rear end of the housing.

8. The lever-type connector of claim 7, wherein the leading end of the projecting piece is arranged at a position to overlap the support in forward and backward directions at the retracted position.

9. The lever-type connector of claim 1, wherein the housing and the lever comprise locking members to hold the lever in a properly mounted state on the housing at the retracted position.

10. The lever-type connector of claim 1, wherein the projection is thinner than another portion of the lever.

11. A lever-type connector, comprising:

a housing having a front end and a rear end from which one or more wires are to be drawn out, at least one wall extending between the front and rear ends and at least one shaft projecting from the wall; and a lever including at least one side plate supported on the shaft of the housing for rotation between a projecting position where the side plate projects to a large extent from the rear end of the housing and a retracted position where the side plate projects to a small extent or does not project from the rear end of the housing, at least one projecting piece projecting forward on a front edge of the side plate a sufficient distance so that a leading end of the projecting piece overlaps the rear end of the housing in forward and backward directions at the projecting position.

12. The lever-type connector of claim 11, wherein the at least one wall of the housing includes two parallel walls, the at least one side plate includes two substantially parallel side plates connected by a coupling, the at least one projecting piece comprising two projecting pieces projecting respectively from the two side plates.

13. The lever-type connector of claim 12, wherein the at least one shaft comprises first shafts projecting from each of the walls, the sides plates of the lever being mounted rotatably on the first shaft on each of the walls, each of the side plates being formed with an escaping space adjacent the respective projecting piece and configured for accommodating the second shaft when the lever is in the retracted position.

14. The lever-type connector of claim 11, wherein the leading end of the projecting piece is aligned with or behind the front end of the housing.

15. The lever-type connector of claim 11, wherein the shaft is supported on a support projecting back from a part of the rear end of the housing.

16. The lever-type connector of claim 15, wherein the leading end of the projecting piece overlaps the support in forward and backward directions at the retracted position.

* * * * *